US007967235B2

(12) United States Patent
Forman et al.

(10) Patent No.: US 7,967,235 B2
(45) Date of Patent: Jun. 28, 2011

(54) DISPENSER THAT AUTOMATICALLY TRANSFERS ROLLS OF ABSORBENT MATERIAL, METHOD OF RELOADING SAME, AND ROLLS OF ABSORBENT MATERIAL FOR USE IN SAME

(75) Inventors: John S. Forman, Appleton, WI (US); Russell G. Wieser, Appleton, WI (US)

(73) Assignee: SCA Tissue North America LLC, Neenah, WI (US)

( * ) Notice: Subject to any disclaimer, the term of this patent is extended or adjusted under 35 U.S.C. 154(b) by 732 days.

(21) Appl. No.: 11/541,666

(22) Filed: Oct. 3, 2006

(65) Prior Publication Data

US 2008/0078855 A1 Apr. 3, 2008

(51) Int. Cl.
*B65H 67/00* (2006.01)

(52) U.S. Cl. ..... 242/560; 242/597.5

(58) Field of Classification Search ..... 242/560, 242/560.1, 560.2, 561, 596.7, 613.5, 597, 242/597.5, 597.6

See application file for complete search history.

(56) References Cited

U.S. PATENT DOCUMENTS

| | | | | | |
|---|---|---|---|---|---|
| 2,299,301 | A | * | 10/1942 | Britt et al. | 242/560.3 |
| 3,132,817 | A | * | 5/1964 | Atwood et al. | 242/597.6 |
| 3,387,902 | A | | 6/1968 | Perrin et al. | |
| 3,627,220 | A | * | 12/1971 | Vogel | 242/613.5 |
| 3,677,485 | A | * | 7/1972 | Berg | 242/560.3 |
| 3,840,194 | A | * | 10/1974 | Vetter | 242/613.5 |
| 4,372,500 | A | * | 2/1983 | Saraisky | 242/613.5 |
| 4,422,584 | A | * | 12/1983 | Dashnier et al. | 242/560.3 |
| 4,856,724 | A | | 8/1989 | Jespersen | |
| 4,977,930 | A | * | 12/1990 | Munk et al. | 242/613.5 |
| 5,125,586 | A | * | 6/1992 | Whitethorn | 242/597.6 |
| 5,288,032 | A | | 2/1994 | Boone et al. | |
| 5,322,234 | A | * | 6/1994 | Robert et al. | 242/596.7 |
| 5,513,820 | A | * | 5/1996 | Meyer | 242/613.5 |
| 5,690,299 | A | * | 11/1997 | Perrin et al. | 242/560 |
| 5,873,542 | A | | 2/1999 | Perrin et al. | |
| 6,752,349 | B2 | | 6/2004 | Moody et al. | |
| 2003/0146337 | A1 | * | 8/2003 | Moody et al. | 242/560 |

* cited by examiner

*Primary Examiner* — William A Rivera
(74) *Attorney, Agent, or Firm* — Young & Thompson

(57) ABSTRACT

A two-roll toilet paper dispenser automatically transfers a new roll into dispensing position once the previous roll is spent or nearly spent. A spring-loaded plate senses the decreasing diameter of the first roll, and once it reaches a predetermined minimum, actuates a linkage that permits a mandrel carrying the two rolls to drop down within the dispenser body and position the second roll for dispensing. The mandrel and track structure permits reloading the dispenser without removing the mandrel. The rolls of toilet paper have adapter plugs in one end only, to ensure that the rolls are placed in the correct orientation within the dispenser.

18 Claims, 10 Drawing Sheets

DISPENSER THAT AUTOMATICALLY TRANSFERS ROLLS OF ABSORBENT MATERIAL, METHOD OF RELOADING SAME, AND ROLLS OF ABSORBENT MATERIAL FOR USE IN SAME

BACKGROUND OF THE INVENTION

1. Field of the Invention

The invention relates to an apparatus for automatically transferring rolls of absorbent material such as toilet paper or other wiping materials, as well as a method for reloading such an apparatus, and rolls of absorbent material specially adapted for use the apparatus.

2. Description of Related Art

In conventional multi-roll sheet dispensing apparatus, material from a first roll of absorbent material is incrementally dispensed through a dispensing opening in a housing. In some dispensers, as long as there is material on the first roll, a lever remains in position to prevent a second roll from falling down by gravity.

U.S. Pat. No. 5,288,032 to Boone et al. is a dispenser of that type. However, in such dispensers, each roll of absorbent material requires two core plugs, which may lead to core plug insertion issues and which also permits a roll of toilet paper to be positioned in either of two orientations, such that the sheets could come from behind and under the roll, instead of the preferred over the top orientation. In addition, there are sometimes retention problems with the spent cores in that the cores are prone to fall out of the dispenser and onto the floor.

Several attempts have been made to address the above-noted problems including U.S. Pat. No. 5,873,542 to Perrin et al. and a more recent attempt shown in U.S. Pat. No. 6,752,349 to Moody et al.

The device of Perrin attempts to solve the issue of the spent cores by using a mandrel. However, the device of Perrin does not automatically transfer the second roll once the first roll runs out. Rather, a user must physically dislodge the mandrel from a stop portion to enable the mandrel to slide down so that the second roll can be accessed.

The device of Moody is complicated in that it requires not only a specialized latch dog assembly on the mandrel, but also removal of the entire mandrel from the dispenser in order to load a new roll.

SUMMARY OF THE INVENTION

An object of the invention is to overcome one or more of the above-described shortcomings of the prior art, or to alleviate one or more of those shortcomings of the prior art at least in part.

Another object of the invention is to have a relatively simple device for automatically transferring rolls of absorbent material that can be loaded and reloaded by a simple technique.

BRIEF DESCRIPTION OF THE DRAWINGS

The above and other objects and advantages of the invention will become apparent from the following detailed description of preferred embodiments thereof, given with reference to the accompanying drawing figures, in which.

DETAILED DESCRIPTION OF THE PREFERRED EMBODIMENTS

Figure 1:
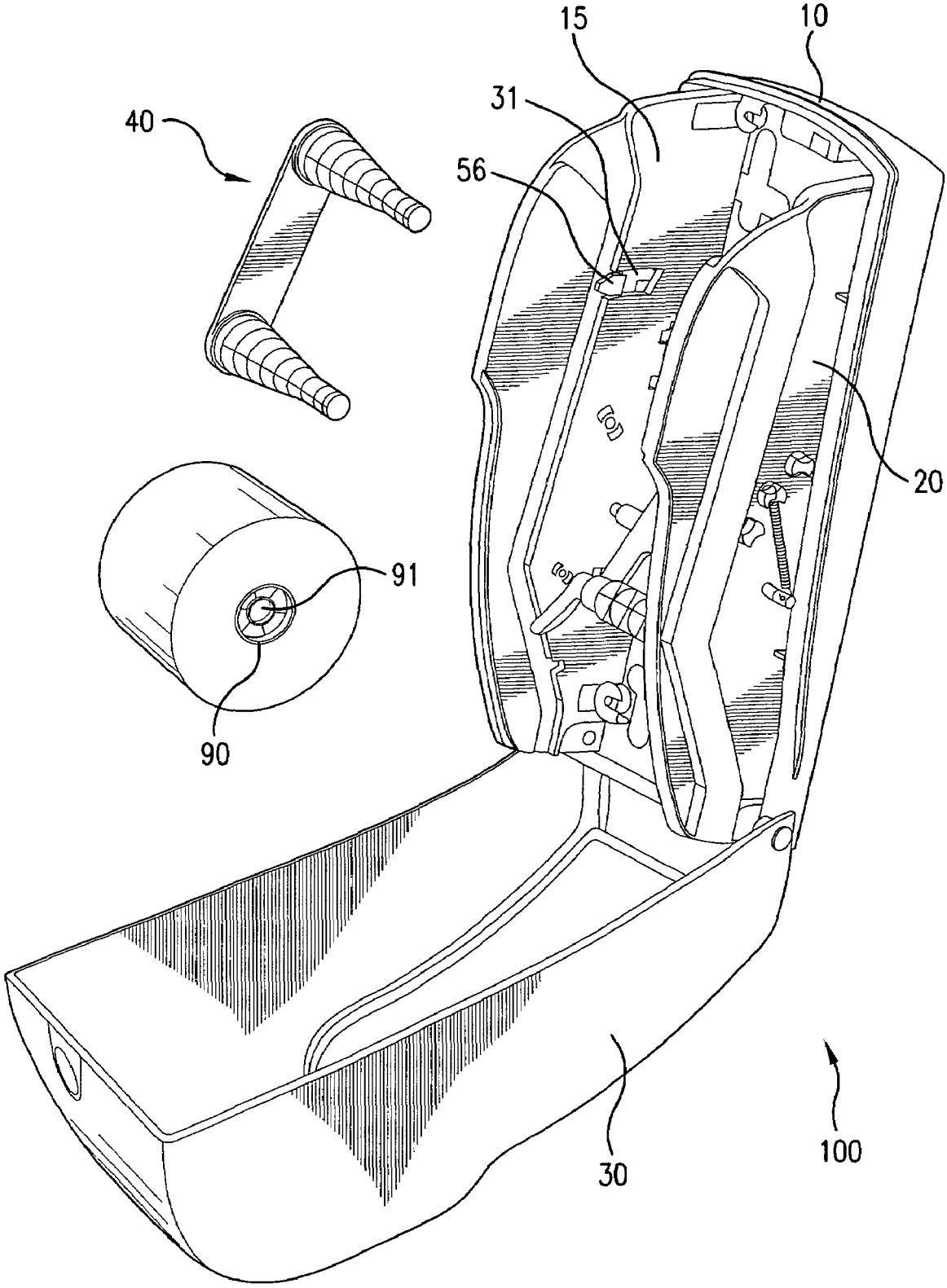
FIG. 1 is a perspective view of a first embodiment of a dispenser according to the invention in an open position.

FIG. 1 shows a dispensing device 100 for automatically transferring a second roll (see R2 in FIG. 4) of absorbent material to be dispensed when a first roll R1 is spent or substantially spent.

Figure 2:
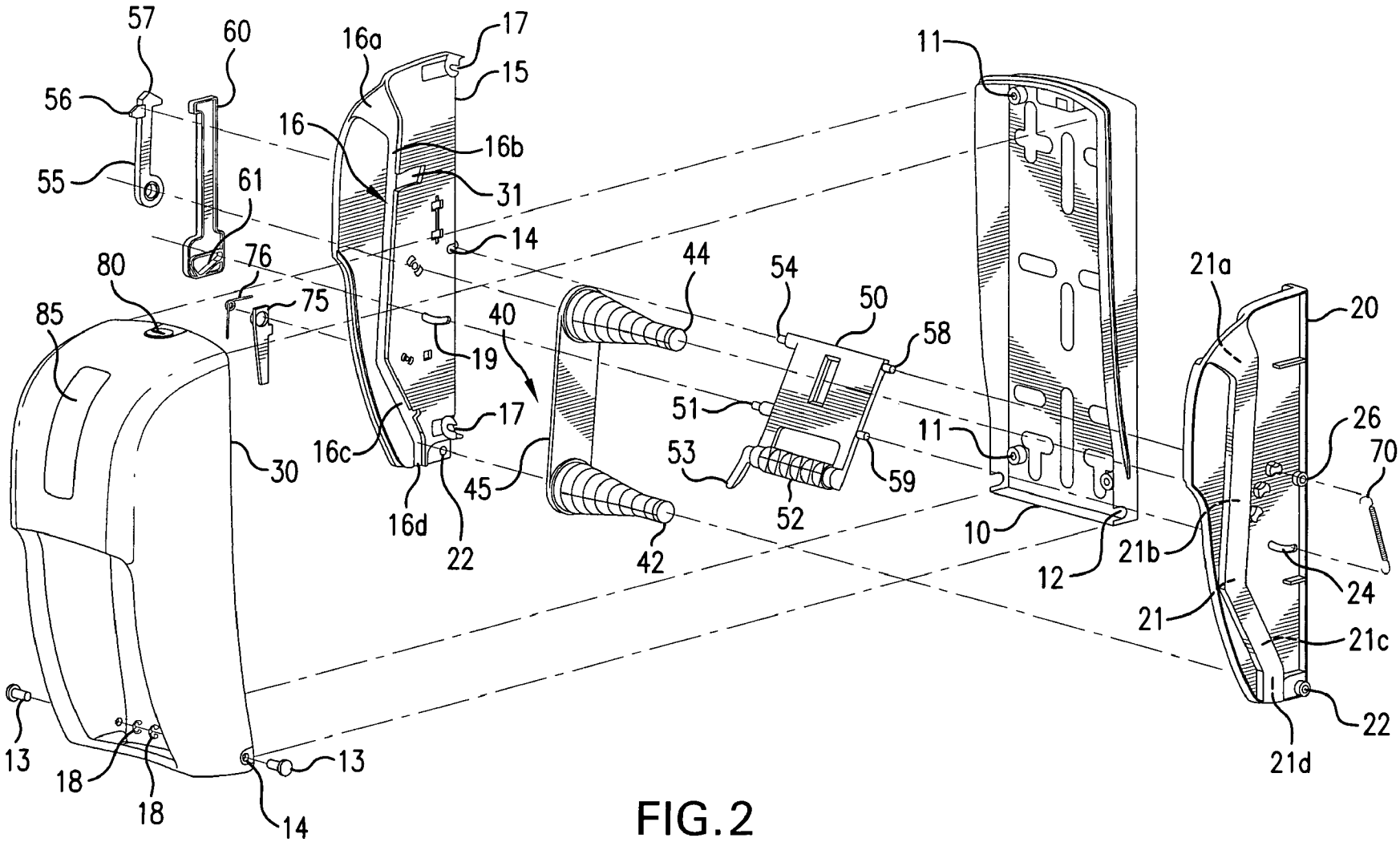
FIG. 2 is an exploded view of the dispenser according to FIG. 1.

With respect to FIGS. 1 and 2, the dispensing device 100 includes a main body having a back portion 10 and first and second side portions 15, 20. A cover 30 is pivotally mounted to the first and second side portions 15, 20 using, for example, pins 13 and clips 18, with pins 13 passing through openings 14 in cover 30, then through slots 12 in back portion 10, and then through bores 22 in side portions 15, 20. However, any known manner of connecting two elements that pivot with respect to each other including, cotter pins, nut/bolt/washer combinations and any other element is contemplated by the present invention. As shown in FIG. 1, the side portions 15, 20 are nested within back portion 10, and secured for example by screws (not shown) passing through slots 17 on the side portions 15, 20 and threaded bores 11 on the back portion 10. The cover 30 is pivotal between an open loading position as seen in FIG. 1 and a closed dispensing position. The cover 30 may include a transparent portion 85 as shown in FIG. 2 so that a user can see whether there is a second roll of absorbent material in the dispenser 100 without opening the cover 30.

As shown in FIG. 2, each of the side portions 15, 20 includes a mandrel channel. Left-hand side portion 15 includes mandrel channel 16. Right-hand side portion 20 includes mandrel channel 21.

Figure 4:
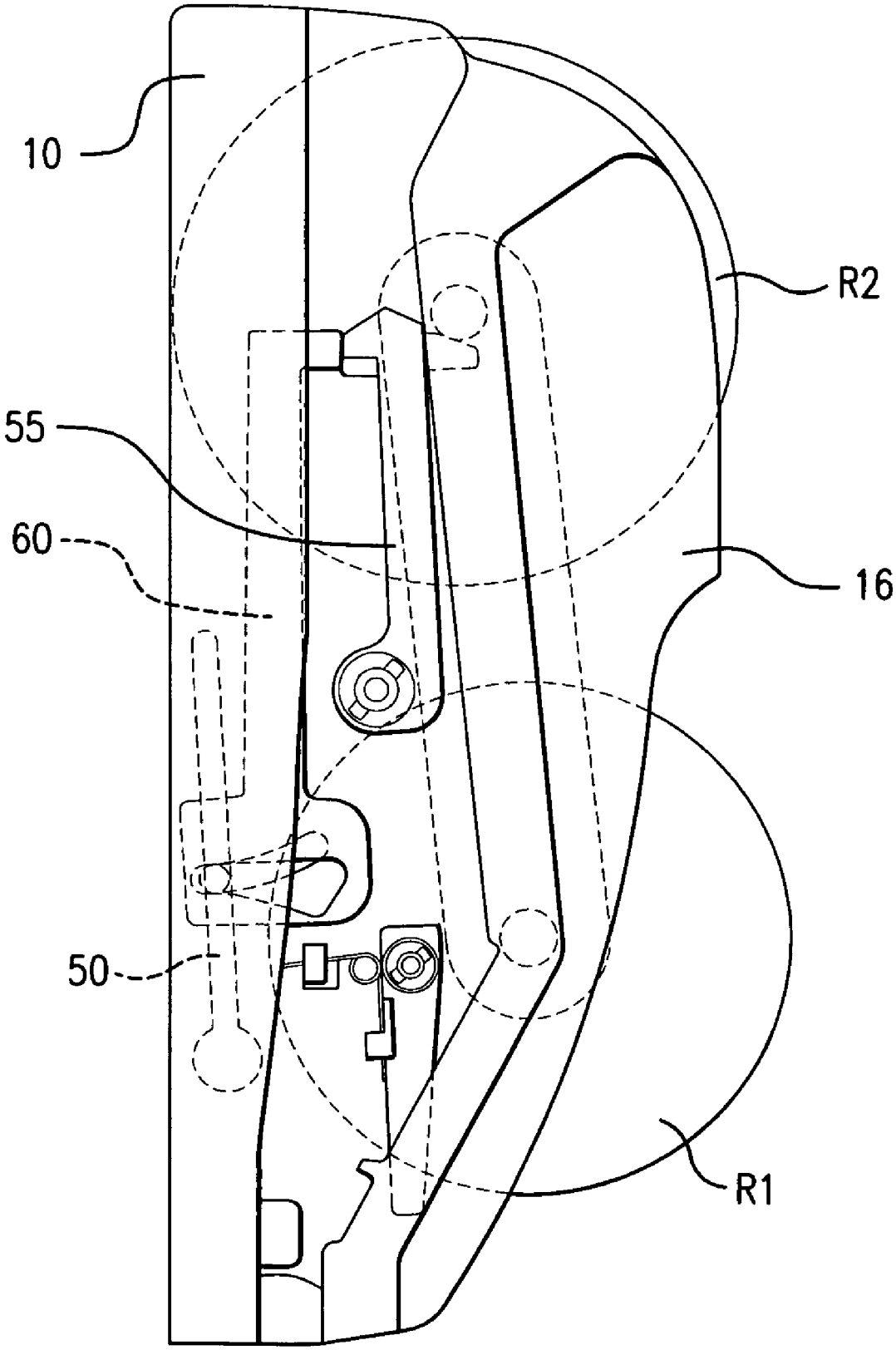
FIG. 4 is a side view with the cover removed for clarity showing an embodiment of the invention when the mandrel is in a first position.
Figure 6:
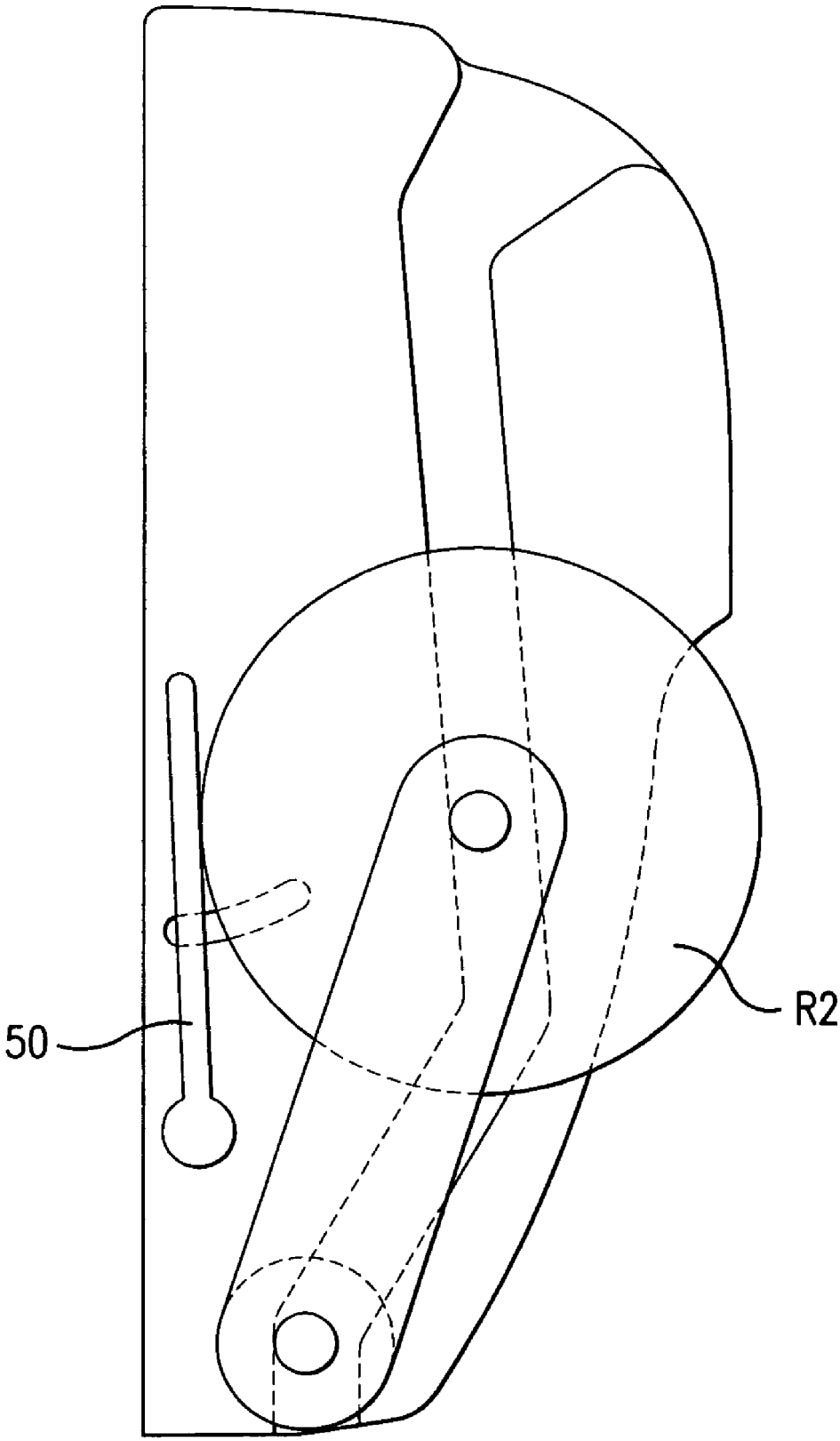
FIG. 6 is a sectional view showing an embodiment of the invention when the dispenser cover is closed and the mandrel is in a second position.
Figure 7:
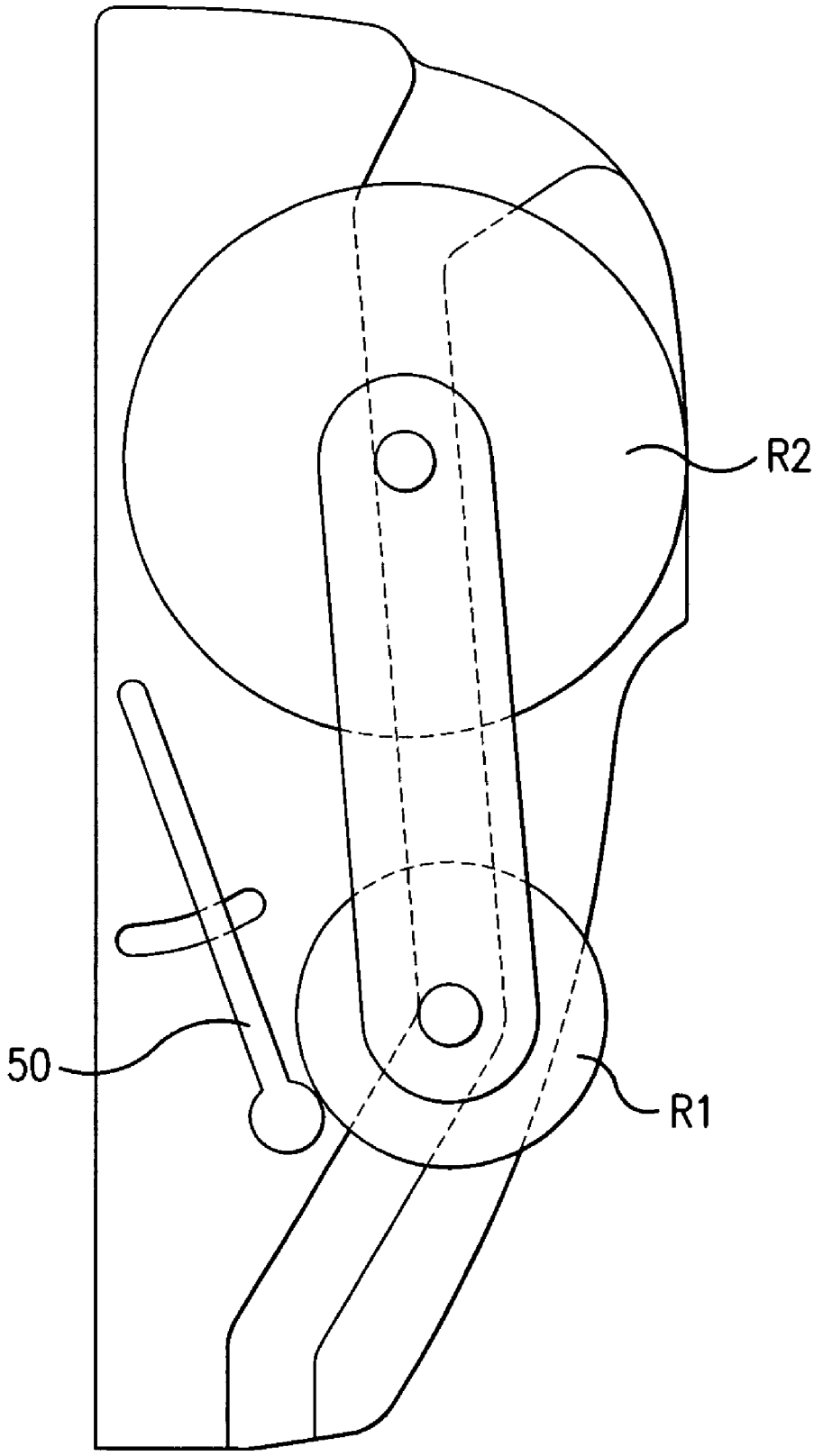
FIG. 7 is a sectional view showing the mandrel in the first position and the sensor plate in a second position.
Figure 8:
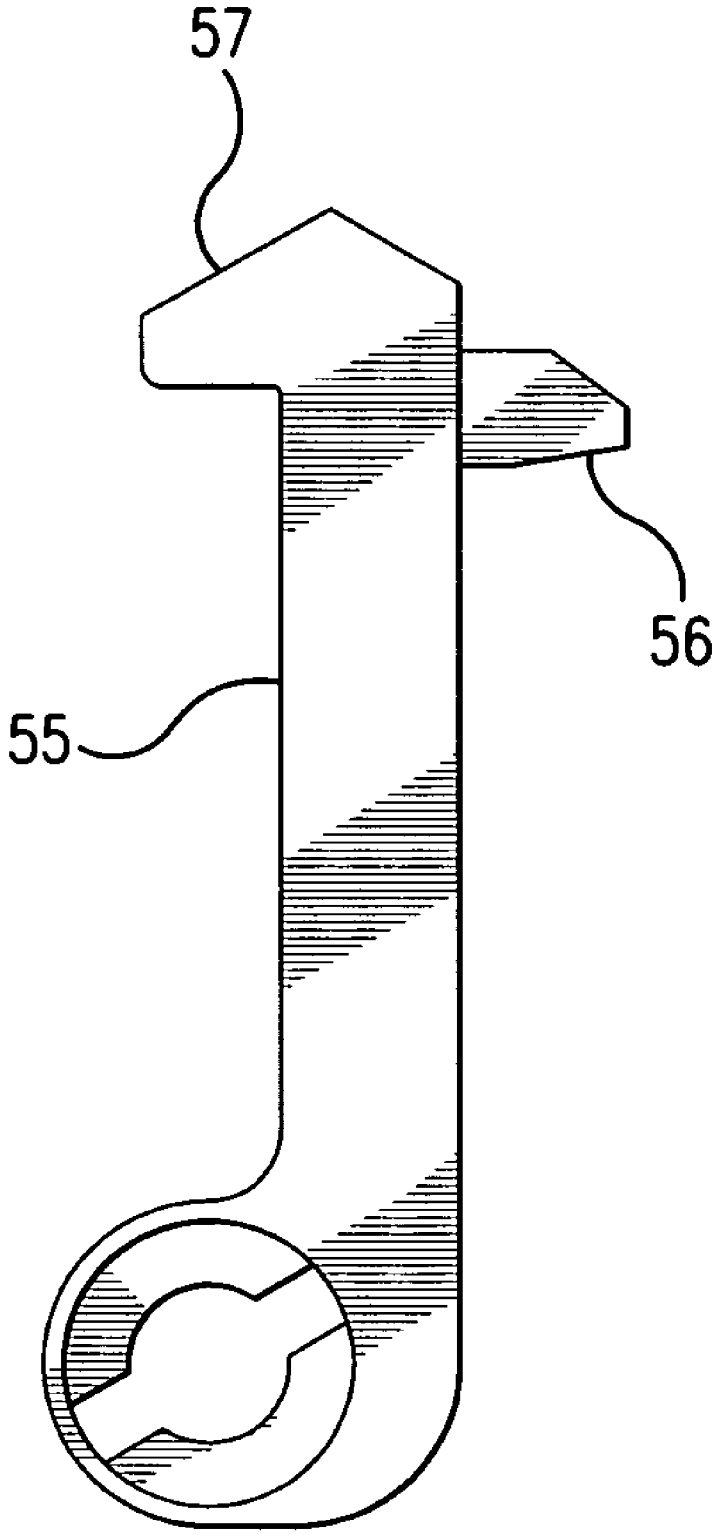
FIG. 8 is a side view of a transfer link according to an embodiment of the invention.

A support mandrel 40 is slidably positioned in the mandrel channels 16, 21. The support mandrel 40 has first and second roll holding elements 42, 44. The support mandrel 40 in use moves automatically between a first position for dispensing sheets of absorbent material from a first roll R1 of absorbent material contained on the first roll holding element 42 as shown in FIG. 4 and a second position for dispensing sheets of absorbent material from a second roll R2 of absorbent material contained on the second roll holding element 44 as shown in FIG. 6. As shown in FIG. 6, the first roll R1 of absorbent material is spent or substantially spent when the support mandrel 40 is in the second position.

Figure 3:
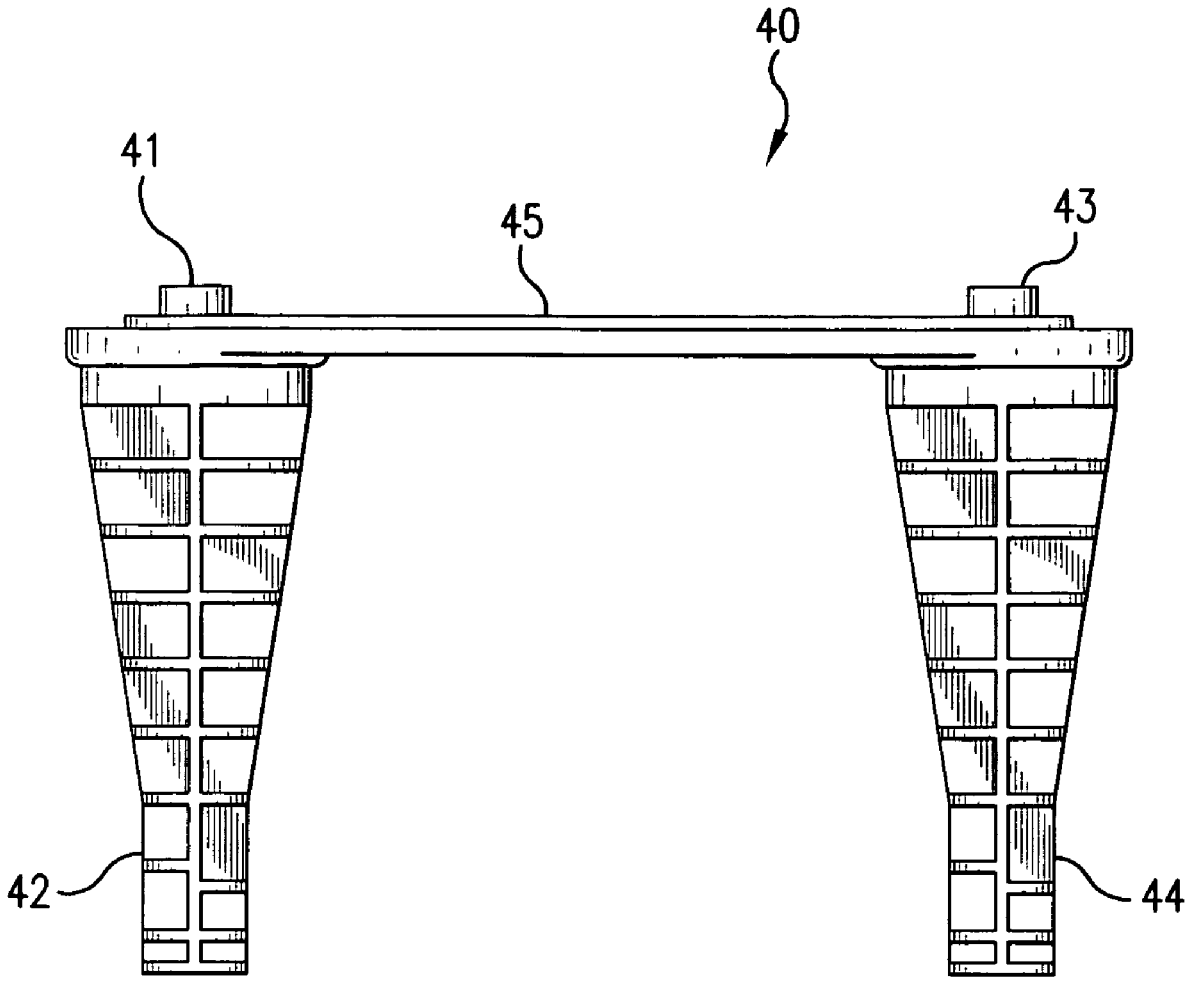
FIG. 3 is a top view of a support mandrel according to an embodiment of the invention.

In the embodiment of FIGS. 2 and 3, the support mandrel 40 includes a flange 45 having first and second opposing sides. Guide elements 41, 43 extend in a first direction from the first side of the flange 45 and have a first diameter. The roll support elements 42, 44 extend from the second side of the flange 45 in a second direction opposite the first direction. The roll support elements 42, 44 are each tapered from a proximal end to a free distal end. The diameter of the proximal end closely corresponds to the inner diameter of a roll of toilet paper, so as to hold the same rotatably but with as little play as possible. The distal ends have a diameter that is greater than the diameter of the guide elements 41, 43, but less than the diameter of the proximal ends. That difference in diameter between the distal ends and the guide elements, and the fact that channel 16 is narrower than channel 21, means that the mandrel can be inserted into the dispenser only in one orientation, i.e., in this embodiment, with the free distal ends pointing to the right as the dispenser is viewed from the front.

Each roll support element 42, 44 is preferably coaxial with a corresponding one of the guide elements 41, 43. The proximal end of the roll support elements 42, 44 is preferably non-rotatable.

As shown in FIG. 2, the dispenser also includes a sensor plate 50 that is disposed between side portions 15, 20 and pivotally mounted thereto via pins 54, 58 received in openings 14, 26. The sensor plate 50 is urged forwardly by a spring 70 that is connected at its upper end to a boss on the outer side of side portion 20, and at its lower end to a pin that projects laterally from sensor plate 50 through an arcuate slot 24 formed in side portion 20.

Sensor plate 50 bears via roller 52 against the outer periphery of a lower roll R1 of toilet paper. As the toilet paper is withdrawn from roll R1 by users, spring 70 urges the roller 52 to maintain in continuous contact with roll R1. Thus, as the toilet paper on roll R1 is consumed, the diameter of that roll steadily diminishes, and the plate 50 gradually pivots forwardly, causing pins 59 and 51 to travel forwardly in arcuate slots 24 and 19, respectively.

Pin 51 of sensor plate 50 projects through arcuate slot 19, and is received in the generally triangular opening 61 of a slide arm 60 (see FIGS. 2 and 4). Slide arm 60 is mounted for vertical sliding movement on the outer side of side portion 15, and even with the cover removed as in FIG. 4, most of the slide arm is in this embodiment concealed by the lateral parts of back portion 10.

Figure 5:
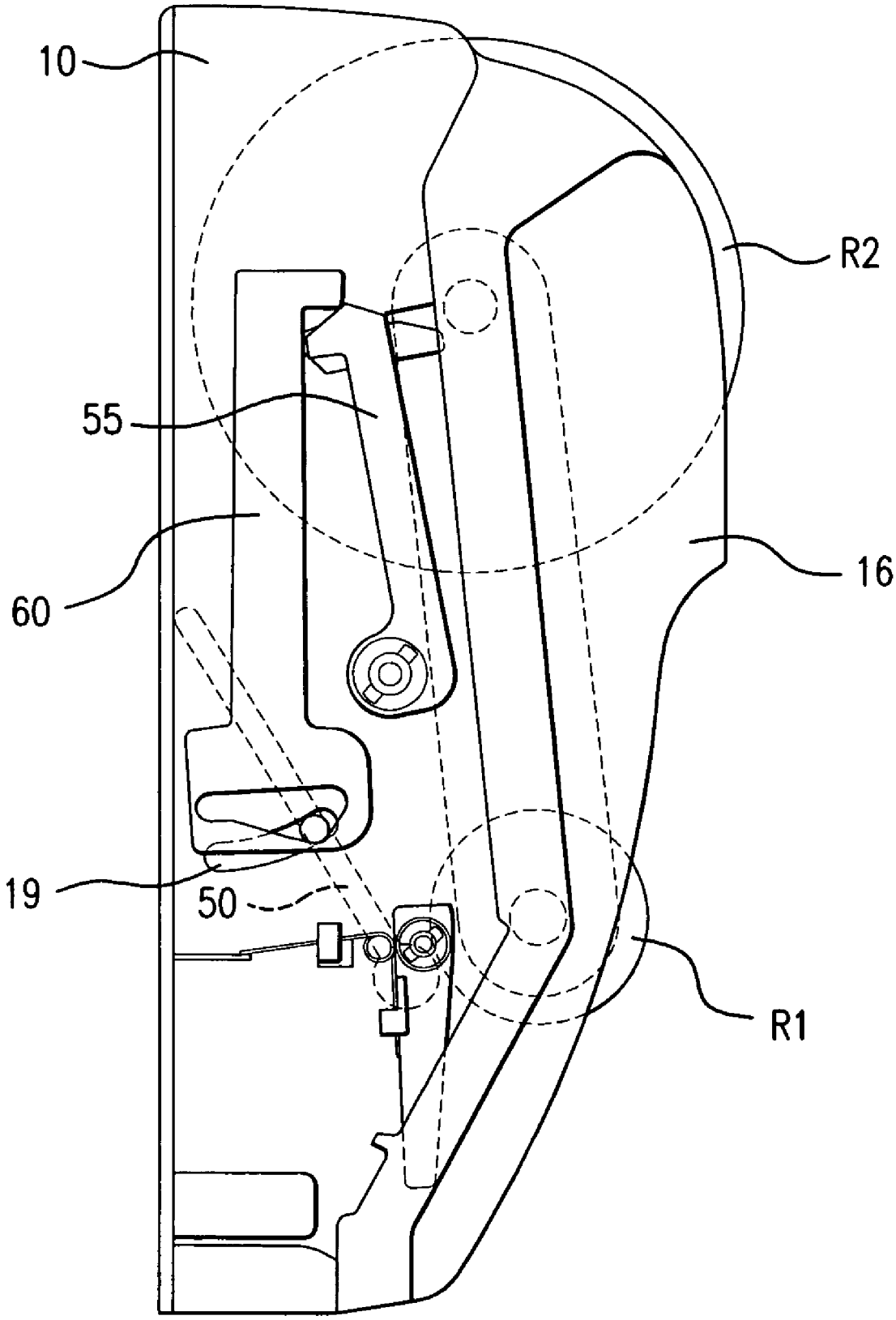
FIG. 5 is a side view similar to that of FIG. 4, when the mandrel has been freed to move to its second position.

Slide arm 60 coacts with a transfer link 55 that is pivotally mounted at its lower end to the outer side of side portion 15. Transfer link 55 includes an upper distal end that contacts the distal end of the slide arm. The upper distal end of transfer link 55 includes a projecting element 56 that passes through an opening 31 formed in side portion 15. Projecting element 56 is moveable from a position as shown in FIGS. 1 and 4 in which it blocks the channel 16 and forces mandrel 40 to stay in the position shown in FIG. 4, to a position as shown in FIG. 5 where transfer link has been pivoted counterclockwise relative top the position shown in FIG. 4, and projecting element is withdrawn from the channel to permit the mandrel to slide downwardly and position roll R2 for dispensing.

As noted above, as the diameter of roll R1 decreases with the withdrawal of toilet paper from the roll, pin 51 travels forwardly in arcuate slot 19. Because the distal end of pin 51 is also received in the opening 61 of slide arm 60, arm 60 is moved progressively vertically upwardly as pin 51 travels forwardly in slot 19. So long as the vertical front-facing surface of the upper end of slide arm 60 is contacting the vertical rear-facing surface of the upper end of transfer link 55, the transfer link 55 is prevented from pivoting counterclockwise, and the projection 56 is kept in the channel 16 through opening 31, thereby blocking the guide element 43 and preventing the mandrel from dropping down (FIG. 4).

However, once the lower roll R1 is empty or nearly empty (or, more generally, has reached a predetermined minimum diameter corresponding to a forward position of pin 51 in slot 19), the slide arm 60 has been raised sufficiently high so as to be free of the blocking contact with the upper end of transfer link 55. Then, the weight of upper roll R2 bearing on the inclined upper surface of projection 56 via guide element 43 causes transfer link 55 to pivot counterclockwise (relative to the vantage point of FIG. 4). The oppositely-inclined surface 57 of transfer link 55 on the outside of side portion 15 at this time coacts with slide arm 60 to raise the same to its maximum vertical position, with pin 51 resting in the bottom of triangular opening 61, as shown in FIG. 5.

The mandrel 40 bearing fresh upper roll R2 and spent or nearly spent lower roll R1 is then free to drop down to the position shown in FIG. 6, in which roll R2 is in dispensing position (albeit slightly higher than the dispensing position of roll R1 in FIG. 4), and in which the lower end of mandrel 40 is confined within the dispenser by cover 30 (channels 16, 21 being open at their upper and lower ends). As the full roll R2 drops down, it deflects the sensor plate 50 backwardly against the action of spring 70, as shown in FIG. 6, so that projection 56 returns to its blocking position inside channel 16. Although there is no mandrel part above projection 56 at this point, its blocking position prevent a user from pushing roll R2 upwardly into the dispenser housing and out of its dispensing position.

Even as the roll R2 is depleted, sensor plate 50 remains deflected rearwardly and projection 56 remains in the blocking position in channel 16, by virtue of the mandrel 40 in this dropped-drown position bearing against the lateral arm 53 provided on sensor plate 50

It is also preferred to include a mandrel channel brake 75 at a lower end of one of the mandrel channels (16 in the embodiment of FIGS. 2 and 4) that slows the movement of the support mandrel 40 between the first and second positions. The mandrel channel brake 75 may also serve to prevent the support mandrel from being pushed up into the cover 30. The mandrel channel brake 75 preferably includes a spring 76 urging the mandrel channel brake 75 into the mandrel channel 16 to slow the movement of the support mandrel 40.

The dispensing device 100 preferably includes a locking mechanism 80 connected to the cover 30 for locking the cover 30 to the back portion 10.

In a presently preferred embodiment, the mandrel channels 16, 21 and/or the guide elements 41, 43 may include motion control grease to control the rate of descent of the support mandrel 40 from the first position to the second position.

In a presently preferred embodiment, the mandrel channels 16, 21 are configured so that when the support mandrel 40 is in the second (dropped-down) position and when roll R2 is a full or substantially full roll, the support mandrel 40 is prevented from being removed from the dispenser even when the cover is in the open position.

As shown in FIG. 2, the mandrel channels 16, 21 are nearly mirror images of each other except that one channel 16 is thinner than the other mandrel channel 21 (and includes opening 31 for projection 56, as discussed above). Each mandrel channel 16, 21 include a wider portion 16*a*, 21*a* at a top thereof for insertion of the support mandrel 40. The mandrel channels 16, 21 also each have a first substantially vertical portion 16*b*, 21*b* adjacent the wider portion 16*a*, 21*a*, an angled portion 16*c*, 21*c* adjacent the first substantially vertical portion 16*b*, 21*b* that is angled toward the back portion 10 and a second substantially vertical portion 16*d*, 21*d* at a bottom of the mandrel channels.

When the support mandrel is in the second position, guide element 43 and the distal end of roll support element 44 of the support mandrel 40 are at the junction between the first substantially vertical portion 16*b*, 21*b* and the first angled portion

16*c*, 21*c*. Due to the substantial remaining thickness of the roll R2 and because of the angled portions 16*c*, 21*c*, sensor plate 50 prevents the support mandrel 40 from being removed from the dispenser even when the cover 30 is open. Once sufficient absorbent material has been removed from the second roll R2, the support mandrel 40 can be withdrawn from the open dispenser at the bottoms of the second substantially vertical portions 16*d*, 21*d*.

Preferably, prior to the material on roll R2 being completely or substantially completely removed from the second roll R2, maintenance personnel will see through window 85 that no upper roll is present, and a new roll of absorbent material will be placed on the empty roll holding element 42. Roll holding element 42 bearing a newly-replaced fresh roll R1 may then be flipped upwardly using elements 43 and 44 still resident in channels 16 and 21, respectively, as a fulcrum, this maneuver involving both pivoting and translation of these elements. The wider portion 16*a*, 21*a* facilitate introduction of the guide element 41 and the roll holding element 42 bearing fresh roll R1 into the mandrel channels 16, 21, and this operation can be performed easily and without ever removing the support mandrel 40 from the dispensing device 100.

Figure 9:
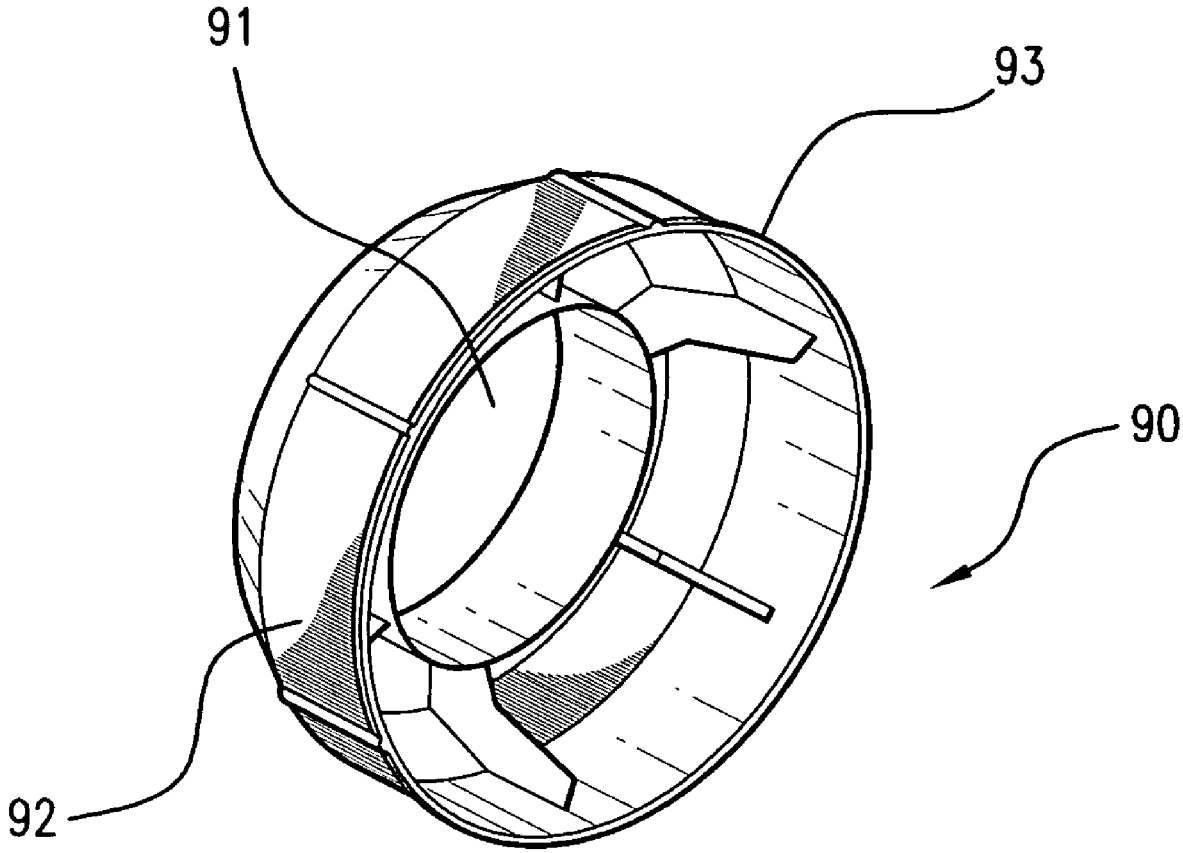
FIG. 9 is a perspective view of the core plug 90 of FIG. 1.

As noted previously, roll holding elements 42, 44 are wider at their base and narrower at their free distal ends. The rolls of absorbent material to be used in the dispenser of the invention preferably include a core plug 90, as shown in FIGS. 1 and 9. The core plug 90 fits snugly into a roll of absorbent material, and preferably has an outer diameter that will be a friction fit via surface 92 inside a standard cardboard toilet paper core. Each of the first and second roll holding elements 42, 44 has a distal end whose diameter preferably corresponds to the diameter of a central opening 91 in the core plug 90, in that the core plug fits over the distal end of the roll holding elements and is rotatable relative thereto, but with as little play as possible.

In operation, as seen in FIGS. 4 and 5, the absorbent material is removed from the first roll R1 until this roll is depleted or substantially depleted. The sensor plate 50 detects that the roll R1 is depleted and then based on the position of the slide arm, as set forth above, the weight of the second roll R2 causes the transfer link to be shifted out of the guide groove 16, enabling the mandrel 40 with the second roll thereon to drop under the influence of gravity. The mandrel moves from the first position as seen in FIG. 4 to the second position as seen in FIG. 5.

Hopefully not long thereafter, a maintenance person will notice that the first roll R1 is spent and must be replaced with a new roll. To replace the roll, the maintenance person opens the cover 30 of the dispensing device 100. The maintenance person then places a new roll of absorbent material on an end of the support mandrel 40. In the shown embodiment, the new roll is placed on roll holding element 44.

However, as would be recognized by one of ordinary skill in the art, the support mandrel is symmetrical about a horizontal axis and the new roll would be placed on the appropriate end that needs replacement. The maintenance person would then pivot the support mandrel 40 about an axis of the roll holding element 42, while the support mandrel 40 is contained within the dispensing device 100. Of course, if the second roll were also sufficiently depleted, the maintenance person could remove the support mandrel 40 from the mandrel channels 16, 21 and add new rolls to both the first and second roll holding elements 42, 44.

If the maintenance person were only replacing a single roll, after pivoting the support mandrel 40, the maintenance person would insert the roll holding element 44 of the support mandrel 40 into the mandrel channels 16, 21 at the wider portion 16*a*, 21*a* at the top of the dispensing device 100. The maintenance person would then close the cover 30. Of course, if the cover 30 were to include a locking mechanism 80, the maintenance person would lock and unlock the locking mechanism 80 at the appropriate times in the loading process.

In the presently preferred embodiment, the new rolls of absorbent material each come pre-packaged with a core plug 90 in only one end to assist in easy installation by making the roll insertable in only one orientation.

Another aspect of the present invention is therefore a roll of absorbent material as depicted for example in FIG. 1 and as described above. The inventive roll of absorbent material is characterized by having openings of distinctly different diameters at its respective sides. In a preferred embodiment, the inventive roll of absorbent material is an otherwise conventional roll of toilet paper having a cardboard core, into one end of which is inserted a core plug 90 as described above. Core plug 90 is preferably an injection molded plastic component, whose outer diameter 92 is a snug fit inside the cardboard core. The core plug preferably also includes a small radially outwardly projecting flange 93 whose outer diameter is greater than the inner diameter of the cardboard core, to prevent the plug from being inserted too deeply. The roll of absorbent material according to the invention includes such a core plug in one end only, to oblige a maintenance person to place the roll into the dispenser in the correct orientation (over the top dispensing, as described above).

Figure 10:
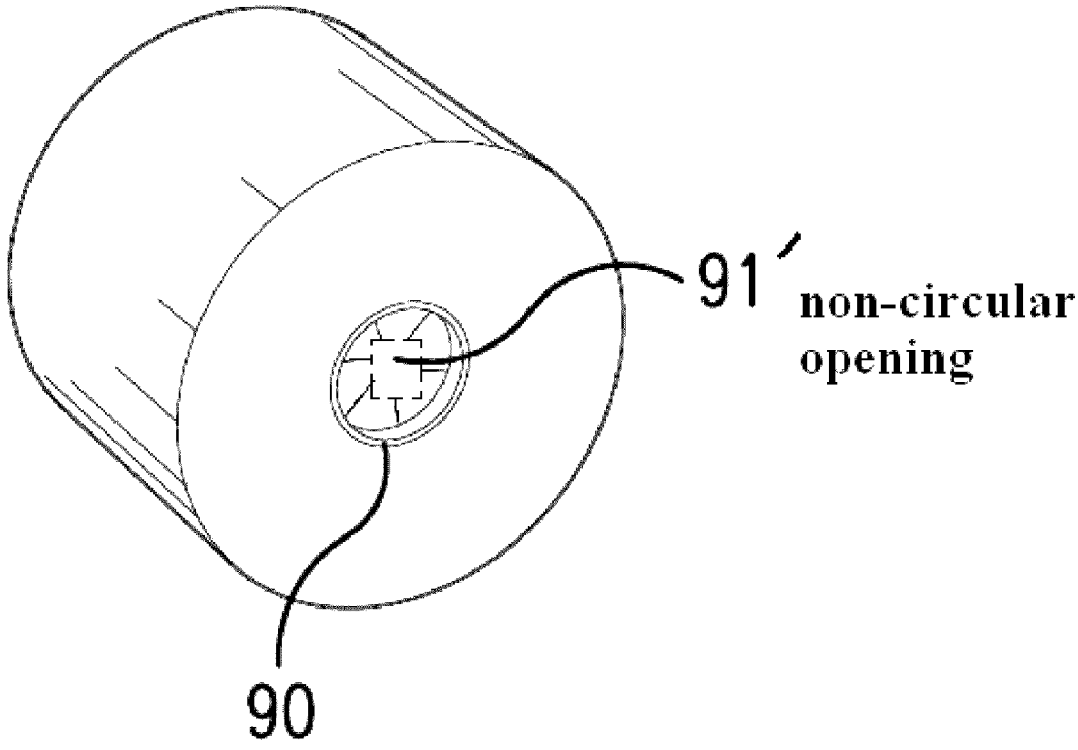
FIG. 10 is a schematic view of a non-circular opening 91' in a core plug according to an embodiment of the invention.

Core plug 90 has a circular central opening 91, which permits mandrel 40 to be made in one piece, because the plugs 90 can spin on the free ends of the roll holding elements 42 and 44. Alternatively, the central opening 91 may be formed in any desired non-circular shape 91' as schematically depicted in FIG. 10. In this case, the distal ends of roll holding elements 42 and 44 are made in a complementary non circular shape, and the roll holding elements are fashioned so as to be rotatable relative to the body of mandrel 40, or alternatively, the non-circular distal ends of roll holding elements 42 and 42 are made rotatable relative to the remainder of roll holding elements 42 and 44.

The invention has been described in detail with respect to presently preferred embodiments. However, it will be apparent to those of skill in the art that changes or modifications may be made without departing from the spirit of the invention. The invention should not be limited by the disclosed embodiments and rather should be defined by the appended claims.

What is claimed is:

1. A dispensing device for automatically transferring a second roll of absorbent material to be dispensed when a first roll of absorbent material has been reduced to a predetermined minimum diameter, said device comprising:

a main body having a back portion and first and second side portions;

a cover pivotally mounted to said main body and being pivotal between an open loading position and a closed dispensing position;

a guide channel on each of said first and second side portions;

a support mandrel slidable in said guide channels, said support mandrel having first and second roll holding elements and being automatically movable between a first position for dispensing sheets of absorbent material from the first roll of absorbent material contained on said first roll holding element and a second position for dispensing sheets of absorbent material from the second roll of absorbent material contained on said second roll holding element;

a sensor plate pivotally mounted in said dispenser, said sensor plate maintaining said support mandrel in said first position before the first roll of absorbent material has been reduced to the predetermined minimum diameter, and enabling said support mandrel to automatically move to said second position when said sensor plate senses that the first roll of absorbent material has been reduced to the predetermined minimum diameter; and a transfer link pivotally mounted on at least one of said first and second sides on a surface opposite to said guide channels, said transfer link being operatively connected to said sensor plate, said transfer link comprising a projecting element that selectively blocks one of said guide channels to prevent the support mandrel from moving between said first and second positions.

2. The dispensing device as claimed in claim 1, further comprising a slide arm slidably connected to said sensor plate, said slide arm preventing said projecting element from coming free from said one of said guide channels before a first roll of absorbent material has been reduced to a predetermined minimum diameter, and permitting said projecting element to be pivoted clear of said guide channel when the first roll of absorbent material has been reduced to a predetermined minimum diameter.

3. The dispensing device as claimed in claim 2, further comprising a first resilient member that urges the sensor plate into contact with a roll of absorbent material disposed in a lower portion of said housing.

4. The dispensing device as claimed in claim 3, further comprising a second resilient element urging said mandrel channel brake into said one of said guide channels to slow the movement of the support mandrel.

5. The dispensing device as claimed in claim 2, further comprising a locking mechanism connected to said cover for locking said cover to said back portion.

6. The dispensing device as claimed in claim 2, wherein said support mandrel comprises:

a flange having first and second opposing sides;

plural guide elements each extending in a first direction from said first side and having a first diameter; and plural roll support elements each extending from said second side in a second direction opposite said first direction, said plural roll support elements each being tapered from a proximal end to a free distal end, a diameter of said proximal end being structured to accommodate a roll of absorbent material, said distal end having a second diameter larger than said first diameter.

7. The dispensing device according to claim 6, wherein a respective one of said plural roll support elements is coaxial with a corresponding one of said plural guide elements.

8. The dispensing device according to claim 7, wherein said proximal end is non-rotatable.

9. The dispensing device as claimed in claim 1, wherein said guide channels are configured such that when said support mandrel is in said second position and when said second roll holding element has a full or substantially full roll of absorbent material thereon, said support mandrel is prevented from being removed from said dispenser even when said cover is in said open position.

10. A method of loading a new roll of absorbent material into the dispensing device according to claim 1 when a previous roll of absorbent material is spent or substantially spent, comprising:

opening the cover of the dispensing device;

placing the second roll of absorbent material on a second end of the support mandrel that is slidable between the guide channels of the dispenser, the first roll of absorbent material already being on a first end of the support mandrel;

pivoting the support mandrel about an axis of the first end while the support mandrel is contained within the guide channels;

inserting the second end of the support mandrel into the guide channels at a top of the dispenser; and closing the cover.

11. The method according to claim 10, wherein upon opening said cover, said second end of the support mandrel slides freely downward out of open bottoms of said guide channels, in order that said second roll of absorbent material can be placed onto said second end.

12. The dispensing device according to claim 1, wherein said support mandrel comprises a single rigid element interconnecting said roll holding elements.

13. A dispensing device for automatically transferring a second roll of absorbent material to be dispensed when a first roll of absorbent material has been reduced to a predetermined minimum diameter, said device comprising:

a main body having a back portion and first and second side portions;

a cover pivotally mounted to said main body and being pivotal between an open loading position and a closed dispensing position;

a guide channel on each of said first and second side portions;

a support mandrel slidable in said guide channels, said support mandrel having first and second roll holding elements and being automatically movable between a first position for dispensing sheets of absorbent material from the first roll of absorbent material contained on said first roll holding element and a second position for dispensing sheets of absorbent material from the second roll of absorbent material contained on said second roll holding element;

a sensor plate pivotally mounted in said dispenser, said sensor plate maintaining said support mandrel in said first position before the first roll of absorbent material has been reduced to the predetermined minimum diameter, and enabling said support mandrel to automatically move to said second position when said sensor plate senses that the first roll of absorbent material has been reduced to the predetermined minimum diameter; and a mandrel channel brake at a lower end of one of said guide channels that slows the movement of said support mandrel between said first and second positions and prevents said support mandrel from being pushed up into said cover.

14. A dispensing device for automatically transferring a second roll of absorbent material to be dispensed when a first roll of absorbent material has been reduced to a predetermined minimum diameter, said device comprising:

a main body having a back portion and first and second side portions;

a cover pivotally mounted to said main body and being pivotal between an open loading position and a closed dispensing position;

a guide channel on each of said first and second side portions;

a support mandrel slidable in said guide channels, said support mandrel having first and second roll holding elements and being automatically movable between a first position for dispensing sheets of absorbent material from the first roll of absorbent material contained on said first roll holding element and a second position for dispensing sheets of absorbent material from the second roll of absorbent material contained on said second roll holding element; and a sensor plate pivotally mounted in said dispenser, said sensor plate maintaining said support mandrel in said first position before the first roll of absorbent material has been reduced to the predetermined minimum diameter, and enabling said support mandrel to automatically move to said second position when said sensor plate senses that the first roll of absorbent material has been reduced to the predetermined minimum diameter, and said sensor plate comprises a roller at a distal end of said sensor plate.

15. The dispensing device as claimed in claim 14, wherein said sensor plate further comprises a lateral arm extending from one side of said distal end of said sensor plate and slidably engaging said support mandrel as said support mandrel slides between said first and second positions.

16. A dispensing device for automatically transferring a second roll of absorbent material to be dispensed when a first roll of absorbent material has been reduced to a predetermined minimum diameter, said device comprising:

a main body having a back portion and first and second side portions;

a cover pivotally mounted to said main body and being pivotal between an open loading position and a closed dispensing position;

a guide channel on each of said first and second side portions;

a support mandrel slidable in said guide channels, said support mandrel having first and second roll holding elements and being automatically movable between a first position for dispensing sheets of absorbent material from the first roll of absorbent material contained on said first roll holding element and a second position for dispensing sheets of absorbent material from the second roll of absorbent material contained on said second roll holding element, said guide channels being configured such that when said cover is in said open position and said support mandrel is in said second position, said first roll holding element is movable to said first position without removing the support mandrel from the dispenser, one channel being thinner than the other channel and each channel includes a wider portion at a top thereof for insertion of said support mandrel; and a sensor plate pivotally mounted in said dispenser, said sensor plate maintaining said support mandrel in said first position before the first roll of absorbent material has been reduced to the predetermined minimum diameter, and enabling said support mandrel to automatically move to said second position when said sensor plate senses that the first roll of absorbent material has been reduced to the predetermined minimum diameter.

17. The dispensing device as claimed in claim 16, wherein said guide channels each have a first substantially vertical portion adjacent said wider portion, a first angled portion adjacent said first substantially vertical portion that is angled toward said back portion and a second substantially vertical portion at a bottom of said guide channels, said support mandrel being removably detachable from said guide channels at said second substantially vertical portion.

18. The dispensing device according to claim 17, wherein said guide channels comprise open bottom portions.

* * * * *